US005163264A

United States Patent [19]

Hannen

[11] Patent Number: 5,163,264

[45] Date of Patent: Nov. 17, 1992

[54] APPARATUS FOR WINDING A STRETCHABLE FOIL AROUND A STACK OF ARTICLES

[75] Inventor: Reiner Hannen, Goch-Pfalzdorf, Fed. Rep. of Germany

[73] Assignee: Develog, Reiner Hannen & Cie, Courtelary, Switzerland

[21] Appl. No.: 712,156

[22] Filed: Jun. 6, 1991

[30] Foreign Application Priority Data

Jun. 6, 1990 [DE] Fed. Rep. of Germany ... 9006375[U]

[51] Int. Cl.[5] ..... B65B 57/00; B65B 13/12

[52] U.S. Cl. ..... 53/64; 53/389.2; 53/389.4; 53/556; 53/588

[58] Field of Search ..... 53/55, 64, 389.3, 506, 53/556, 587, 588, 389.2, 389.4; 242/75.47

[56] References Cited

U.S. PATENT DOCUMENTS

| | | | |
|---|---|---|---|
| 3,032,943 | 5/1962 | Reimers et al. | 53/55 |
| 3,145,945 | 8/1964 | Bowen | 242/75.47 |
| 3,759,432 | 9/1973 | Hutzenlaub | 53/556 X |
| 4,514,955 | 5/1985 | Mouser et al. | 53/588 X |
| 4,706,443 | 11/1987 | Humphrey | 53/556 X |
| 4,712,354 | 12/1987 | Lancaster et al. | 53/588 X |
| 4,756,143 | 7/1988 | Lancaster | 53/556 |
| 4,905,448 | 3/1990 | Plitt | 53/588 X |

*Primary Examiner*—John Sipos
*Assistant Examiner*—Linda B. Johnson
*Attorney, Agent, or Firm*—Herbert Dubno; Andrew Wilford

[57] ABSTRACT

An apparatus for wrapping a stack of articles with a stretch foil in which the satellite has a deflecting roller over which the foil passes and which is braked by a hydraulic motor in proportion to the speed of the deflecting roller. An arm can swing out and carries a mirror to monitor breakage of the foil, the mirror intercepting a light beam from a stationary force on the machine frame. For both the brake and the foil-break monitor, no slip rings are required.

4 Claims, 2 Drawing Sheets

APPARATUS FOR WINDING A STRETCHABLE FOIL AROUND A STACK OF ARTICLES

FIELD OF THE INVENTION

The present invention relates to an apparatus for winding a stretchable foil around a stack of articles or goods, e.g. on a pallet, utilizing a system in which a roll of the foil (usually a thermoplastic synthetic resin material) is caused to orbit the stack and the web is fed at a controlled rate so that as it is wound around that stack it is also stretched. More particularly, the invention relates to an apparatus of this type in which the foil roll is received in a support or frame forming a satellite which is caused to orbit the stack and the foil is applied to the stack after it passes over at least one braked deflecting roller

BACKGROUND OF THE INVENTION

In earlier systems for the wrapping of a stretchable foil around a stack of articles or goods, the satellite is mounted beneath a disk rotatable about a vertical axis and raised and lowered in a machine frame to cause the foil to orbit the stack and wind around it as the satellite is raised or lowered.

The foil, after it is wound off the roll, stretches and is thus wound under tension upon the stack. For this purpose it is guided over at least one deflecting roll which is electrically braked. The electrical energy for this purpose and, in general, the electricity used for control and other purposes in this system is supplied or carried off via slip rings. Slip rings are costly, unreliable and prone to rapid wear, thereby creating maintenance problems. Furthermore, it is difficult with existing systems to control the braking energy or, especially upon start up of the system, to provide a different braking energy than at a subsequent portion of the operating cycle.

OBJECTS OF THE INVENTION

It is, therefore, the principal object of the present invention to provide an apparatus for the purposes described which avoids the drawbacks of the system previously described and which allows improved generation of the braking energy.

Another object of the invention is to provide an apparatus for winding a foil around a stack of articles or goods which eliminates the need for slip rings and the problems associated therewith.

SUMMARY OF THE INVENTION

These objects and others which will become apparent hereinafter are attained, in accordance with the invention by providing the satellite of an apparatus for the foil wrapping of a stack with a brake whose brake force is generated as a function of the rotating movement of the satellite and/or the deflecting roll.

The brake is actuated by the centrifugal force of the satellite and/or the deflecting roller and preferably is formed by a hydraulic pump which can be coupled to the deflecting roller, preferably via a transmission which can be of the gear, friction wheel or belt type. Most advantageously, this transmission can be of a toothed-belt (cog belt) type with a cog belt engaging a cog wheel of the hydraulic pump.

More specifically, an apparatus for winding a stack of articles with a stretchable foil can comprise a satellite member adapted to be orbited around the stack and provided with an orbiting support, a roll of the foil mounted on the support, a deflecting roller member rotatable on the support and around which the foil passes from the roll onto the stack, and brake means operatively connected to at least one of the members and generating a brake force determined by a rotary movement of the one of the members for maintaining a tension on the foil.

With the system of the invention, the braking action no longer requires any slip rings since the brake does not utilize energy supplied from the exterior. The braking force, by contrast, is generated and controlled by the movements of the parts to be braked themselves and, as a consequence, automatically ensures that the braking force will be smaller at start up when the rotating speed of the part to be braked is the smallest. The satellite can thus achieve the desired peripheral speed around the stack of articles rapidly and in a pressure free manner.

According to a feature of the invention, the apparatus is also equipped with a foil-break control system operating with light curtains or switches which respond to a light beam. In these systems as well, slip ring connections are common place. To eliminate such slip rings it is advantageous, according to the invention to provide on the satellite a swing arm which is spring loaded against the foil delivered from the roll to the stack. The swing arm can carry according to this aspect of the invention, a mirror which swings into the path of a light beam or light curtain emitted by a device fixed on the frame or support of the machine.

The swing arm can be provided on the foil side turned away from the frame so that the mirror is shielded by the foil which is supplied to the stack, during its orbit thereof from the light beam or light curtain. Upon a breakage of the foil web, the swing arm can be drawn by its biasing spring into a position in which the light beam is intercepted by the mirror so that the interception triggers a response, or the reflection of the light beam effects the response. The light curtain system can then supply a pulse for stopping the apparatus. In a preferred embodiment of the invention, a double-arm swing lever is provided, one arm being engaged by the spring while the other arm carries a support roll for the foil and the mirror.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 2:
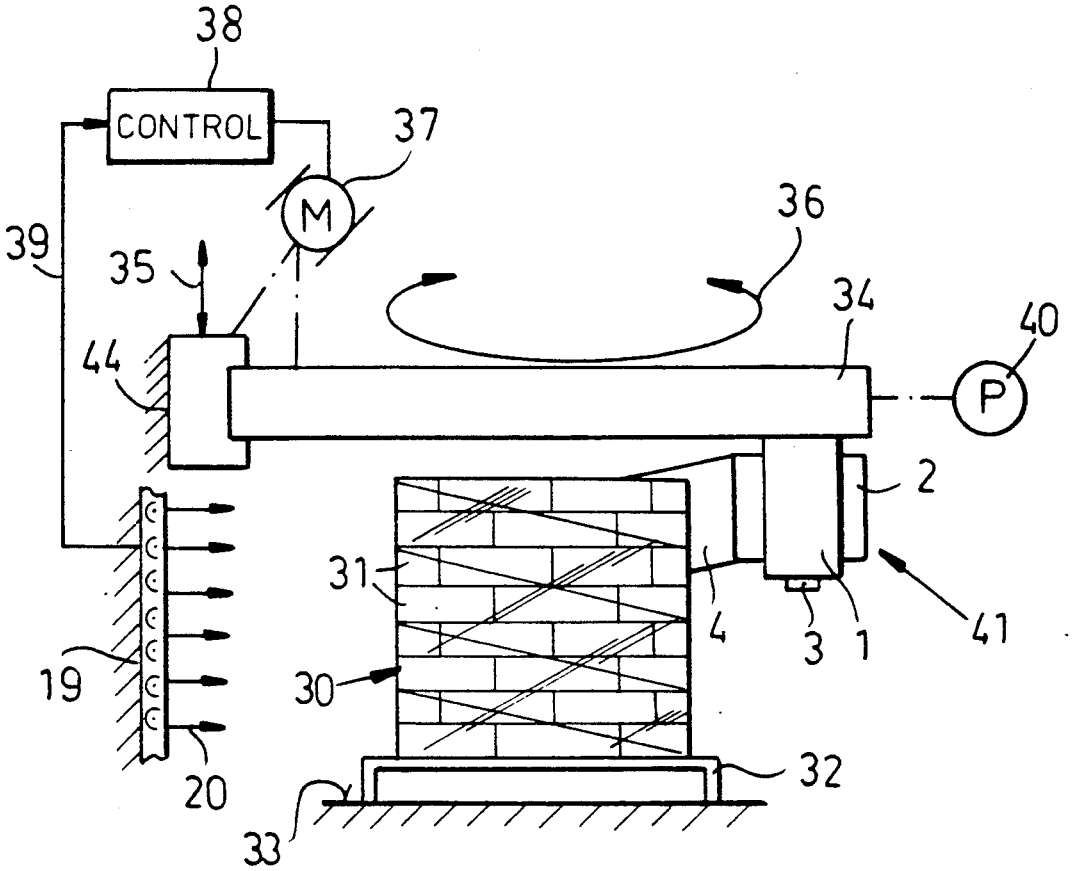
FIG. 2 is a diagrammatic elevational view showing the overall system.

Referring first to FIG. 2, it can be seen that an apparatus for wrapping a stack 30 of articles 31 on a pallet 32 with a foil web 4, e.g. as part of a shrink wrap system, can comprise, in addition to the stack station 33, a disk 34 which can be raised and lowered around the stack as represented by the arrow 35. The disk is also rotatable about a vertical axis as represented by the arrow 36 by the drive 37 operated by a control 38 which, in response to a light curtain 19 to which it is connected by the signal line 39, can cut off the operation of the apparatus.

The disk 34 may be braked by a hydraulic pump 40. The disk carries a satellite 41 having a roll 2 of the web 4 which is delivered to the stack via the pressing rollers shown in FIG. 1 and not visible in FIG. 2.

Figure 3:
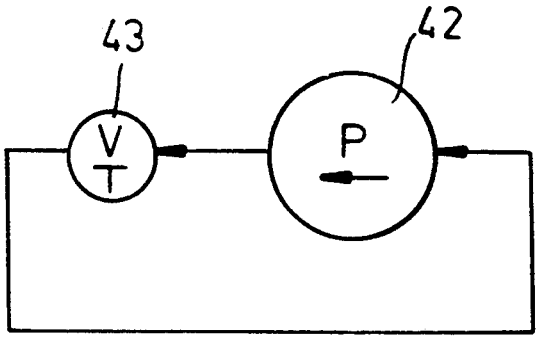
FIG. 3 is a diagram of a hydraulic circuit illustrating the principle of hydraulic braking.

When reference is made herein to a pump functioning as the brake pump, for example, the pump 40 previously described and the hydraulic pump 11 to be described, a hydraulic pump of the type shown at 42 can be used. This pump can be a vane pump whose pressure side is connected in series with a throttle valve 43 (FIG. 3) whereupon the hydraulic medium is returned to the inlet side of that pump.

Figure 1:
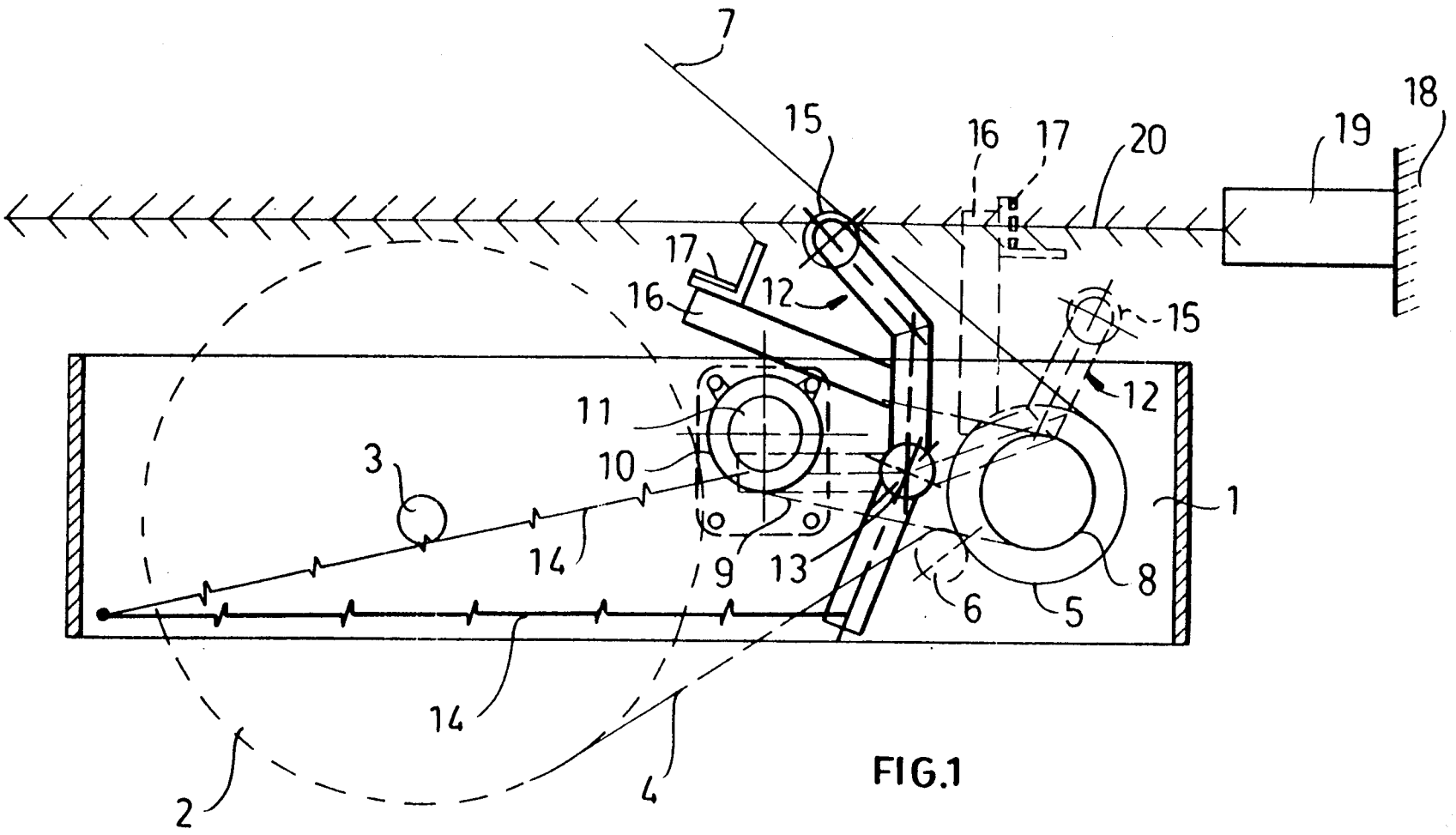
FIG. 1 is a section seen in plan view through a satellite according to the invention, partly broken away and illustrating the apparatus.

Turning now to FIG. 1, in which the base plate 1 of the satellite is shown, it may be mentioned that the satellite is suspended from the annular disk as described which can be rotated about a vertical axis and raised an lowered in a support frame represented only at 44 in FIG. 2. The satellite thus undergoes a circular movement around the stack 30 to wrap the stretchable foil 4 therearound. The foil roll 2 is rotatable on the base plate 1 about a vertical shaft 3 which also forms the means for rotatably mounting the roller foil on the satellite. The foil web 4 passes from the roll 2 over a deflecting roller 5 which is also journaled on the base plate. The foil 4 can be pressed by a pressing roller 6 against the deflecting roller 5.

To ensure stretching of the foil 4 over its segment 7 between the deflecting roller 5 and the stack, the deflecting roller 5 is braked.

The deflecting roller 5 is provided with a toothed wheel or cog wheel 8 around which a toothed or cog belt 9 passes. The cog belt 9 is also guided around a further cog wheel 10 connected to the hydraulic pump 11. The braking effect on the deflecting roller 5 will depend upon the speed of the deflecting roller and thus the braking force is lower at start up and higher at full speed. The braking force can be adjusted by adjusting the throttling of the valve 43.

FIG. 1 of the drawing also shows that the base plate 1 carries a double-arm swing lever 12 which can pivot about a vertical axis 13. A tension spring 14 engages one arm of the swing lever 12 while its other end is fastened to the base plate. The other arm of the swing lever 12 carries a support roller 15 which provides support for the web as it is applied to the stack. The arm carrying the support roller 15 also is formed with a holder 16 for a mirror 17.

Outside the circular path of the satellite a support 18, which can be connected to the support 44, is provided for a device 19 forming a light curtain or light beam/-photoelectric cell device. The light beam 20 from this system is visible in FIGS. 1 and 2.

As long as the foil 4 is intact, i.e. is not torn, the swing arm 12 will have its support roller 15 lying against the foil on the side of the foil turned away from the device 19 and under the force of the tension spring 14. This is clearly visible by the solid line configuration of the arm shown in FIG. 1. The light beam 20 is reflected by the outer side of the foil or is absorbed. Should the foil tear or the foil segment between the deflecting roller 5 and the stack somehow fail, the swing arm 12 is swung by the tension spring 14 into the broken line position shown in FIG. 1 in which the light beam 20 is intercepted by the mirror 17 and the reflected beam caused to generate a pulse or signal to the control 38 to halt the operation of the satellite.

I claim:

1. An apparatus for winding a stack of articles with a stretch foil, the apparatus comprising:

a station receiving a stack of articles to be wrapped with a stretch foil;

a frame adjacent said station; and a satellite on said frame orbitable around said stack, said satellite comprising:

an orbiting support, means on the support holding a roll of said foil on said orbiting support, the foil being engaged with the stack and being pulled from the roll with a payout speed proportional to a speed at which the satellite orbits the stack, a deflecting roller rotatable on said orbiting support and around which said foil passes from said roll onto said stack as said satellite orbits said stack, said deflecting roller being entrained by the said foil with a peripheral velocity corresponding to the payout speed, a hydraulic pump on said orbiting support forming a rotation retarder and rotatable to generate a brake force on said deflecting roller, a transmission on said orbiting support positively coupling said deflecting roller with said hydraulic pump, and hydraulic means connected with the pump for retarding rotation of the pump with a force proportional to the peripheral velocity of the deflecting roller and the orbiting speed of the satellite for maintaining a constant tension in the foil between the deflecting roller and the stack such that said brake force increases as the orbital speed of said satellite increases.

2. The apparatus defined in claim 1, further comprising a light curtain foil-breakage monitor including;

a spring loaded swing arm pivotal on said support, engageable by said foil and carrying a mirror swingable into a light path of a light curtain source located on said frame upon rupture of said foil.

3. The apparatus defined in claim 2 wherein said swing arm is disposed on a side of said foil opposite that along which said source is disposed.

4. The apparatus defined in claim 2 wherein said swing arm is a double-arm lever having one arm engageable by a spring and another arm having a support roll for foil and carrying said mirror.

* * * * *